United States Patent [19]

Hanyu et al.

[11] Patent Number: 4,664,545

[45] Date of Patent: May 12, 1987

[54] PAPER FEEDING MECHANISM OF PRINTING MACHINE

[75] Inventors: Susumu Hanyu; Hideaki Takenoya, both of Hachioji; Fumiyuki Mishima, Hino, all of Japan

[73] Assignee: Janome Sewing Machine Industry Co., Ltd., Japan

[21] Appl. No.: 790,649

[22] Filed: Oct. 24, 1985

Related U.S. Application Data

[63] Continuation of Ser. No. 618,293, Jun. 7, 1984, abandoned.

[30] Foreign Application Priority Data

Jun. 8, 1983 [JP] Japan ..... 58-86412[U]

[51] Int. Cl.[4] ..... B41J 11/30

[52] U.S. Cl. ..... 400/616.2; 400/642

[58] Field of Search ..... 400/616, 616.1, 616.2, 400/642

[56] References Cited

U.S. PATENT DOCUMENTS

| | | | |
|---|---|---|---|
| 3,421,612 | 1/1969 | Pitt | 400/616.1 |
| 3,656,602 | 4/1972 | Konkel | 400/616.2 |
| 3,746,142 | 7/1973 | Hepp | 400/636 |
| 3,837,461 | 9/1974 | Waibel | 400/124 |
| 4,072,225 | 2/1978 | Manning | 400/636 |
| 4,234,261 | 11/1980 | Hendrischk | 400/616.2 |
| 4,386,861 | 6/1983 | Kurihara | 400/124 |

FOREIGN PATENT DOCUMENTS

| | | | |
|---|---|---|---|
| 33964 | 4/1981 | Japan | 101/93.05 |
| 39980 | 3/1982 | Japan | 400/616.1 |

OTHER PUBLICATIONS

Humphreys; IBM Tech Disc Bulletin; vol. 25, No. 4, Sep. 1982, p. 2193.

*Primary Examiner*—Clyde I. Coughenour
*Attorney, Agent, or Firm*—William A. Drucker

[57] ABSTRACT

A printer of a wire-dot impact type is provided forwardly of the housing an inlet opening for introducing a printing paper to the inside and has an outlet opening provided at a rear side of the housing for discharging the printing paper to the outside. The printing paper is transported by cooperation of a tractor arranged near the outlet opening and a feed roller arranged near the inlet opening, to thereby run inside the housing in substantially a straight path of travel from the inlet opening to the outlet opening, during which the printing paper is printed by means of a platen and a printing head, both provided between the feed roller and the tractor. A pair of guide members are provided between the feed roller and the printing unit and between the printing unit and the tractor, respectively, to thereby feed the printing paper along the straight path of travel.

1 Claim, 4 Drawing Figures

PAPER FEEDING MECHANISM OF PRINTING MACHINE

This application is a continuation of application Ser. No. 618,293, filed June 7, 1984, now abandoned.

BACKGROUND OF THE INVENTION

This invention relates to a printing machine in general, and more particularly to a paper feeding mechanism for use in a printing machine designed to transport the paper to be printed substantially in a linear path from a paper inserting port to a paper feed-out port.

FIG. 1 diagrammatically shows the prior art printing machine of so-called wire-dot impact type, in which a printing paper 2 is supplied from an inlet 3 provided in the rear (i.e., at the right in FIG. 1) of the machine 1, and is transported in the direction of the arrow A by means of a platen 4 and then is guided to the outside through an outlet 7 also provided in the rear of the machine 1. In the meantime a printing head 6 is operated to print the paper 2 by means of an intermediate ink ribbon 5. In this case, as shown, the paper 2 travelling inside the machine 1 will describe substantially a U-shaped path turning around the platen 4, and thereby it has often been failed to smoothly transport the paper 2. Moreover, paper 2 would contact with ink saturated members of platen 4 in a wide area, resulting in a great probability that the paper would be undesirably contaminated by ink. Furthermore, paper 2 has to be inserted into the machine 1 through the inlet 2 with its normal side down. This may be a serious inconvenience especially when the printing side has been provided a graph in which some characters must be printed, as the operator can not refer to the graph for properly printing the characters in a definite position in the graph as required. Moreover, it has been inevitable that a device for supplying a long continuous printing paper must be positioned in the rear of the machine 1, resulting in that a desk or the like on which the machine 1 has to be placed is required to provide a sufficient space rearwardly of the machine.

SUMMARY OF THE INVENTION

Accordingly the invention has been provided to eliminate defects and disadvantages of the prior art printer.

An object of the invention is to provide a novel printing machine of wire-dot impact type, capable of smoothly transporting a printing paper therethrough in substantially a straight line.

Another object of the invention is to prevent a printing paper from being contaminated by a platen of a printing machine while travelling therethrough.

Still another object of the invention is to provide a wire-dot impact type printer into which a printing paper introduced with the printing side being visible to the operator.

Briefly, the above is accomplished by providing a printing machine of wire-dot impact type having a housing with an inlet opening provided at a foreside thereof for introducing a printing paper and an outlet opening provided rearwardly thereof for discharging the paper which has been printed. A printing unit is located in the housing between the inlet opening and the outlet opening and comprises a platen having a plurality of ink saturated members provided on a periphery thereof and a printing head disposed opposite to the platen, between which the paper is passed to be printed.

A tractor is disposed between the printing unit and the outlet opening and rotated in a predetermined direction for transporting the printing paper which has been printed toward the outlet opening. A feed roller is disposed between the inlet opening and the printing unit and rotated in dependence upon the tractor in the same direction to feed the printing paper to the printing unit. Also, a pair of guide members are disposed in the paper transporting path, one of the guide members being arranged between the feed roller and the printing unit and the other one of the guide members being arranged between the printing unit and the tractor, at least one of the guide members having an arcuate guide surface defined by a center axis positioned on the side of the printing head. The tractor, feed roller and guide members are positioned to form a substantially straight path from the inlet opening to the outlet opening. In this manner the printed part of the printing paper is guided radially away from the platen with respect to the tangent extending between the platen and the printing head.

BRIEF DESCRIPTION OF THE DRAWINGS

The foregoing and further objects and advantages of the invention can be fully understood from the following detailed description when read in conjunction with the accompanying drawings in which.

PREFERRED EMBODIMENTS OF THE INVENTION

Figure 1:
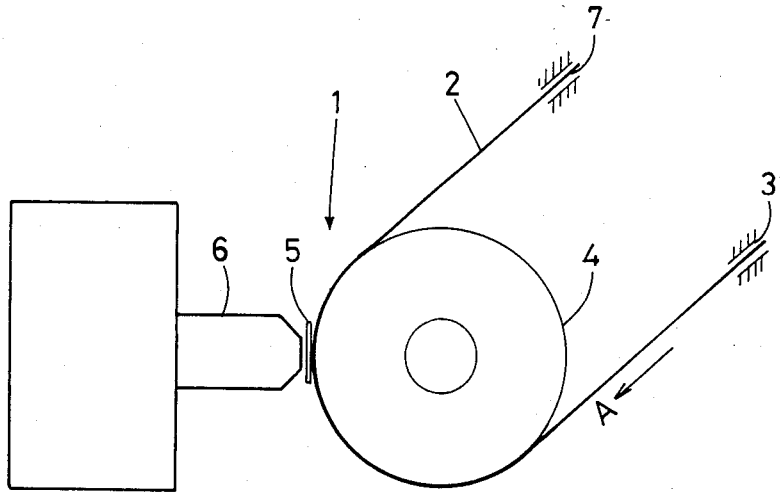
FIG. 1 is a view diagrammatically showing a main part of the prior art wire-dot impact type printing machine.
Figure 2:
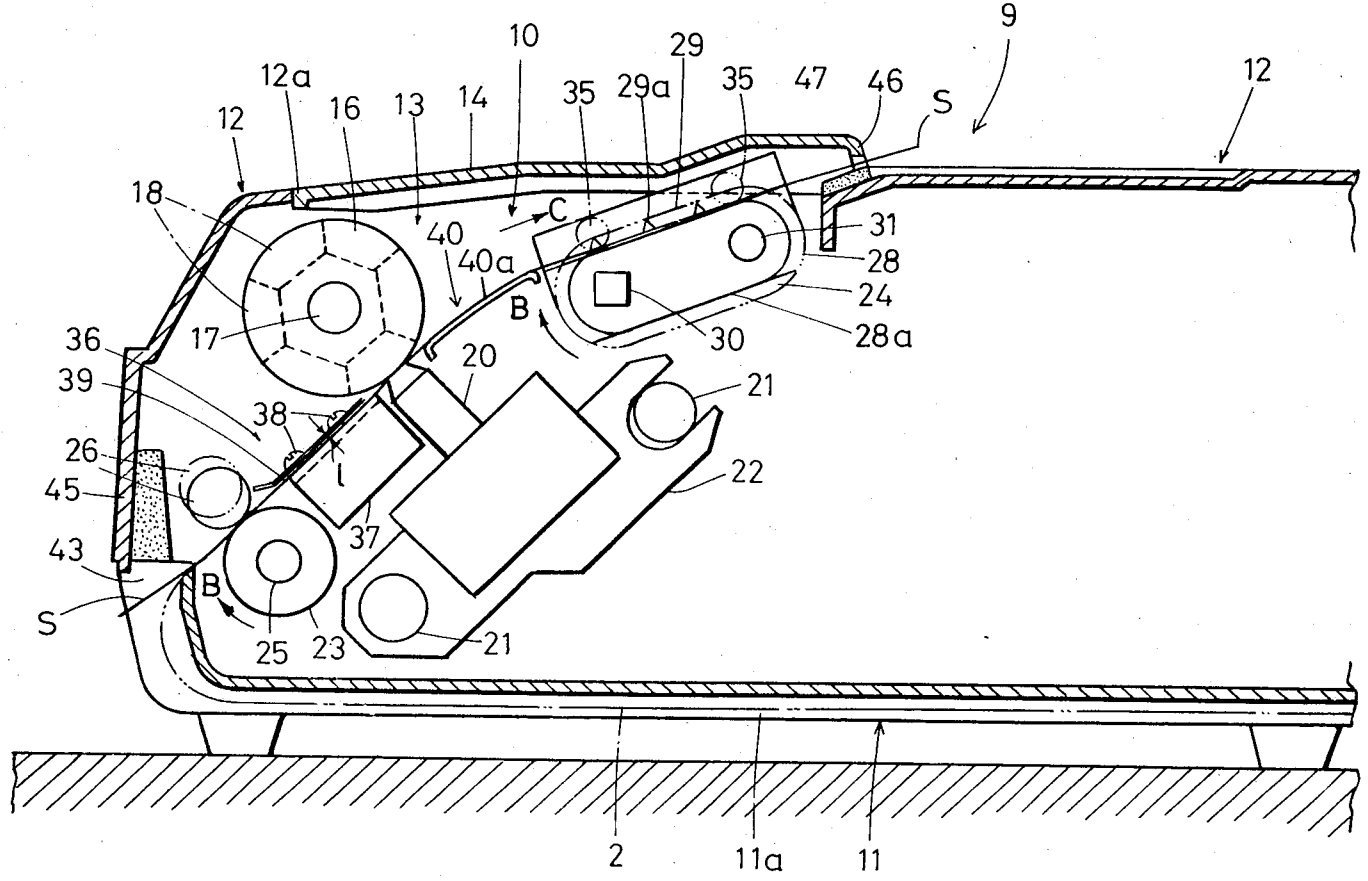
FIG. 2 is a sectional side view diagrammatically showing a printing machine provided with a paper feeder embodying the invention.

Referring specifically to FIG. 2, a paper feeding mechanism 10 of the invention is provided within a space 13 defined by a base 11 and a cover 12, which are cooperated with each other to form a housing of a printing machine 9. The cover 12 is provided at the top and forwardly thereof an opening 12*a* adapted to closed by a transparent panel 14 for making the inside visible to the operator.

In the housing of the printer 9 is rotatably supported a shaft 17 carrying a platen 16 having a plurality of ink saturated members 18 of different colors mounted on the periphery thereof. A printing head 20 is arranged to confront the platen 16 and is secured to a carriage 22 which is slidable along a pair of stationary guide axes 21.

In the path of travel of a printing paper (S), a pair of feed rollers 23 (one of which is seen) are arranged forwardly of the platen 16 and the printing head 20, while a pair of tractors 24 (one of which is seen) are arranged rearwardly of platen 16 and printing head 20. The feed roller 23 is rotatable about an axis rotatably mounted on the housing, and a press roller 26 is arranged adjacent the feed roller 23 and is movable with respect to the latter.

The tractor 24 is composed of a main body 28 and an endless belt 29 having a series of pawls 29*a* formed thereon. The main body 28 is supported in the housing by means of a rotary drive shaft 30 of a tetragon in section and a stationary supporting axis 31. The belt 29 is wound around an arched part 28*a* of the main body 28, and is rotated in the direction of the arrow B together with rotation of the drive shaft 30. The belt 29 with pawls 29*a* is applicable to the case in which a fanfold paper or the like having pinholes is used as a printing paper, whereby the paper can be transported in the direction of the arrow C with the pinholes of the paper being engaged with pawls 29*a* of belt 29. In the case wherein another kind of printing paper is used such as a roll paper without pinholes engageable with pawls 29*a*, the belt 29 is replaced by a flat belt (not shown) which will cooperate with a pair of rollers 35 shown in dotted line in FIG. 2 to feed the paper in the same way.

A first guide member 36 for properly guiding the paper (S) in the predetermined travelling path is disposed between the feed roller 23 and the printing head 20. More particularly, a first guide plate 39 is secured to a fixed base member 37 by screws 38 with a predetermined clearance (l) provided therebetween, and the paper (S) is adapted to pass through the clearance (l). A second guide plate 40 is stationarily arranged between the printing head 20 and the tractor 24, whose guide surface 40*a* will define a circular arc which substantially connects the top face of the base member 37 and the top face of the arched part 28*a* of the main body 28 of the tractor 24 and which has a center axis on the side of the prihting head 20.

At the fore side of the printer 9, there is provided a clearance between base 11 and cover 12 to form an inlet 43 for inserting the paper (S) therethrough. A soundproof material 45 is attached to the inside of the cover 12 so as to properly reduce the width of the inlet 43. An outlet 46 for feeding out the printed paper (S) to the outside is provided between cover 12 and panel 14, and a soundproof material 47 is provided in the same manner as in the inlet 43.

The operation and function of the above desribed device will now be described: At first, the press roller 26 is moved away from the feed roller 23 to a retired position shown in imaginary lines in FIG. 2. Then the paper (S) is introduced into the machine 9 through the inlet 43 to be passed between the feed roller 23 and press roller 26, through the clearance (l) provided between the first guide plate 39 and the base 37, and along the arcuate face 40a of the second guide plate 40, and then the pinholes of the paper (S) are engaged with the pawls 29*a* of the tractor belt 29. Then the press roller is moved to come into contact with the feed roller 23 as shown in a solid line, to thereby apply a proper pressure to the paper (S) passing between the press roller 26 and the feed roller 23. In this condition, when the drive shaft 30 is energized to rotate in the direction B, the belt 29 is rotated in the same direction to transport the paper (S) and accordingly the feed roller 23 is caused to rotate in the same direction B. Thus the paper is transported in the direction C through the clearance (l) between the first guide plate 39 and the base member 37 and along the top face 40*a* of the second guide plate 40, and then issued to the outside from the outlet 46. In the meantime, a selected one of the ink saturated members 18 and the printing head 20 having a plurality of wires (not shown) provided therein will cooperate with each other to print the paper (S) as desired by the operator. In case the paper (S) is supplied from a port (not shown) rearwardly of the machine 9, the paper may be guided to the inlet 43 by way of a recessed path 11*a* provided on the underside of the base 11 as illustrated by a broken line.

Figure 3:
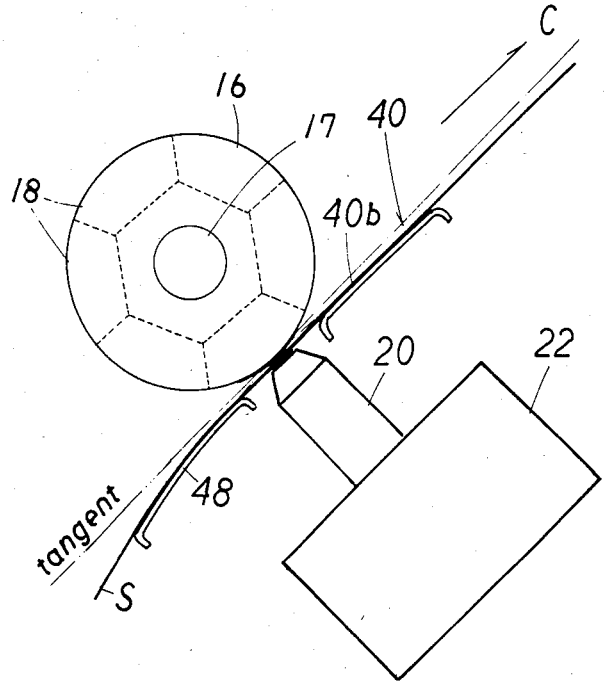
FIGS. 3 and 4 are views diagrammatically showing modified embodiments of the paper feeder of the invention, respectively.
Figure 4:
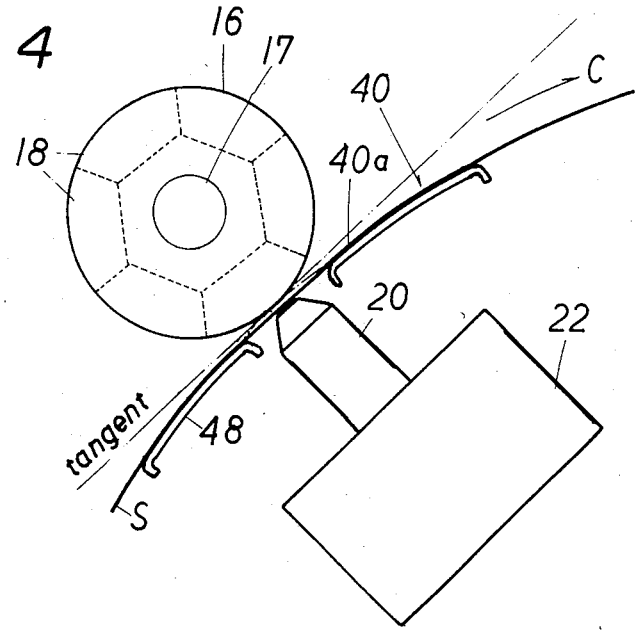

FIGS. 3 and 4 show different embodiments of the invention respectively. More particularly, in the embodiment shown in FIG. 3 the guide surface of base 37 of the first guide member 36 is made a circular arc 48 whereas the second guide plate 40 is modified to have a flat guide surface 40*b*. In this case, the first guide plate 39 is correspondingly modified to have an arched face in relation to the arcuate surface 48 of the base 37. FIG. 4 illustrates another embodiment which has the first guide member 36 of the same construction as in the case of FIG. 3 but is modified therefrom such that the second guide plate 40*b* has the arcuate guide surface 40*a* as in the case of FIG. 2.

In summary, according to the invention there is provided the first and second guide members in the forward and rearward of platen 16 and printing head 20, respectively, for properly feeding the printing paper (S) in the printing machine 9, and at least one of the guide members is provided with a circularly arc shaped guide face 48, 40*a*, having a center axis on the side of the printing head 20, whereby the paper (S) is subjected to contact with the ink saturated members 18 of the platen 16 only at a point just between the platen 16 and the printing head 20, and therefore the paper may be prevented from being contaminated by the ink saturated members 18 before and after the paper is printed.

Moreover, the paper (S) is fed inside the machine 9 in substantially a straight line from the inlet 43 provided at the fore side of the machine, 9 toward the outlet 46 provided at the rear side, resulting in the smooth feed of the paper (S) and a greatly decreased probability of misfeeding. Furthermore, a paper supply for continuously supplying the paper (S) can be disposed forwardly of the machine 9 as well as rearwardly thereof, which will assure that the printer 9 can be positioned at any desired place. Where the paper supply should be positioned in the rear of the printer 9, the paper (S) is supplied therefrom through a concaved path 11*a* provided for the base 11, as shown by a broken line in FIG. 2.

While the invention has been described in conjunction with specific embodiments thereof, it is to be understood that many different variations and modifications may be made without departing from the spirit and scope of the invention.

What is claimed is:

1. A printing machine of wire-dot impact type comprising a housing having an inlet opening provided at a foreside thereof for introducing a printing paper and an outlet opening provided rearwardly thereof for discharging the paper which has been printed; a printing unit located in said housing between said inlet opening and said outlet opening and comprising a platen having a plurality of ink saturated members provided on a periphery thereof and a printing head disposed opposite to said platen, between which the paper is passed to be printed; a tractor arranged between said printing unit and said outlet opening and rotated in a predetermined direction for transporting the printing paper which has been printed toward said outlet opening; a feed roller arranged between said inlet opening and said printing unit and rotated in dependence upon said tractor in the same direction to feed the printing paper to said printing unit and a pair of guide members arranged in said paper transporting path, one of said guide members being arranged between said feed roller and said printing unit and the other of said guide members being arranged between said printing unit and said tractor, at least one of said guide members having an arcuate guide surface defined by a center axis positioned on the side of said printing head to give a tension to said printing paper along said arcuate guide surface while maintaining the printed part of the printing paper radially spaced from a tangential face of said platen where the wire-dot impact is given by said printing head through said printing paper wherein said tractor, said feed roller and a pair of guide members are arranged to form a substantially straight path from said inlet opening to said outlet opening.

* * * * *